US007753721B1

(12) United States Patent
Wu

(10) Patent No.: US 7,753,721 B1
(45) Date of Patent: Jul. 13, 2010

(54) ELECTRICAL ADAPTED WITH REPLACEABLE PLUG STRUCTURE

(75) Inventor: Michael Wu, Hsin Tien (TW)

(73) Assignee: Formosa Electronic Industries Inc., Taipei Hsien (TW)

( * ) Notice: Subject to any disclaimer, the term of this patent is extended or adjusted under 35 U.S.C. 154(b) by 0 days.

(21) Appl. No.: 12/461,215

(22) Filed: Aug. 5, 2009

(30) Foreign Application Priority Data

Jun. 30, 2009 (TW) ..... 98211792 U

(51) Int. Cl.
*H01R 29/00* (2006.01)

(52) U.S. Cl. ..... 439/518; 431/172; 431/131

(58) Field of Classification Search ..... 439/131, 439/518, 172, 173
See application file for complete search history.

(56) References Cited

U.S. PATENT DOCUMENTS 6,669,495 B2 * 12/2003 Philips et al. ..... 439/170
7,118,399 B1 * 10/2006 Wen et al. ..... 439/166
7,179,105 B1 * 2/2007 Hung ..... 439/172
7,232,322 B1 * 6/2007 Yen et al. ..... 439/222
7,654,838 B1 * 2/2010 Zhuge ..... 439/173

* cited by examiner

*Primary Examiner*—Briggitte R Hammond
(74) *Attorney, Agent, or Firm*—Rosenberg, Klein & Lee

(57) ABSTRACT

An electrical adapter with a replaceable plug structure includes an adapter housing and a plug mounting/dismounting structure mounted to the adapter housing. The plug mounting/dismounting structure includes a carrier, at least one set of contact plates, and at least one releasable fastening structure. The contact plates are in electrical connection with a circuit assembly accommodated in the adapter housing and are exposed on the carrier. The releasable fastening structure is mounted to the adapter housing and includes at least one pair of pushbuttons and at least one pawl section, which is set at a locked position when the pushbuttons are not depressed and is set at a released position when the pushbuttons are depressed in a predetermined operation direction. A plug structure is coupled to the carrier of the plug mounting/dismounting structure with a coupling surface thereof and the plug structure is selectively locked/released by operation of the pawl section.

9 Claims, 7 Drawing Sheets

ELECTRICAL ADAPTED WITH REPLACEABLE PLUG STRUCTURE

FIELD OF THE INVENTION

The present invention relates to the design of electrical adapters, and in particular to an electrical adapter with a replaceable plug structure.

BACKGROUND OF THE INVENTION

In the modern commercialized and industrialized society where international business and leisure travels occur frequently, a user who uses personalized portable electrical appliances, such as a mobile phone, a battery charger, and a chargeable electrical shaver, may need to travel to various countries or areas of the world. The electrical power supplied in different countries and the specifications of the wall sockets in different countries may be different, so that a single charging plug is certainly not suitable for different countries. Due to this reason, a user must carry a few electrical adapters that meet the specifications of electrical power supplied and the wall sockets when he or she is traveling abroad. However, each individual electrical adapter currently available in the market only suit for use in a specific country or area, and thus a user must purchase a new adapter corresponding to a different foreign country where he or she is going to visit, and the newly purchased adapter may not be useful in the next travel to another foreign country. This is a troublesome problem. Thus, manufacturers are providing products of adapter that comprise parent and child plugs for different socket specifications.

SUMMARY OF THE INVENTION

However, the known adapter with parent and child plugs includes plugs of two or three specifications. Although it is effective to overcome the drawback that the traditional electrical adapter is only suitable for one specific socket, yet it is still not possible to meet the specifications of all possible sockets available in the world. Further, including more plugs of different specifications in a single adapter product may cause an undesired expansion of the overall dimensions thereof. For a user traveling abroad, various luggages are carried and an over-sized adapter makes it inconvenient to carry in the luggage.

Thus, an objective of the present invention is to provide an electrical adapter with a replaceable plug structure, which allows the adapter to replace the plug for suiting different socket specifications in different countries.

Another objective of the present invention is to provide an electrical adaptor that can be combined with various plugs for suiting different specifications of socket in different countries so as to allow convenient carrying by a user.

A further objective of the present invention is to provide an electrical adapter that has a readily releasable plug to facilitate convenience and efficiency of plug replacement.

The solution adopted in the present invention to overcome the problems of the conventional techniques comprises an electrical adapter with a replaceable plug structure, comprising an adapter housing and a plug mounting/dismounting structure mounted to the adapter housing, characterized in that the plug mounting/dismounting structure comprises a carrier, at least one set of contact plates, and at least one releasable fastening structure, wherein the carrier is arranged at a predetermined position in the adapter housing, the contact plates are in electrical connection with a circuit assembly accommodated in the adapter housing and are exposed on the carrier, and the releasable fastening structure is mounted to the adapter housing and comprises at least one pair of pushbuttons and at least one pawl section, which is set at a locked position when the pushbuttons are not depressed and is set at a released position when the pushbuttons are depressed in a predetermined operation direction.

When a plug structure is set to have a coupling surface thereof coupled to the carrier of the plug mounting/dismounting structure, the contact plates are allowed to physically engage corresponding plug-mating contact tabs formed in the coupling surface of the plug structure and the pawl section of the fastening structure, which is set at the locked position, corresponds in position to and engages a corresponding locking slot defined in the plug structure. When the pawl section is forced to the released position, the locking slot is allowed to disengage from the pawl section of the fastening structure, whereby the plug structure is removable from the carrier.

In the electrical adapter described above, the plug structure may comprise a two-prong plug, a three-prong plug (of which one prong is a grounding prong, or a cigarette lighter type plug.

In the electrical adapter described above, the carrier may form a recessed structure.

In the electrical adapter described above, the contact plates may comprise contact plates for transmitting alternating current power or contact plates for transmitting direct current power.

In the electrical adapter described above, the adapter housing may form at least one universal serial bus (USB) socket, which is electrically connected to the circuit assembly.

With the solution provided by the present invention, the drawback that the plug of an electrical adapter can only be used with a socket of a specific specification is eliminated. The electrical adapter may replace the plug to suit the different socket specifications in different countries so as to allow convenient use by a user traveling in different countries and areas and enhance the usability of the present invention. Further, since the present invention allows for replacement of plugs of various specifications, the present invention is thus suitable for all specifications. A user may select and replace a proper plug for the country or area where he or she is going to visit. Thus, the present invention provides excellent versatility and eliminate the drawback that an electrical adapter must be associated with a plurality of plugs of different specifications and thus occupy a great amount of space, so that the space that an electrical adapter may occupy in a luggage is substantially reduced to facilitate carrying by the user and thus enhance the utilization thereof. Further, the present invention uses a releasable fastening structure to couple a plug and an electrical adapter together, and this facilitates efficient mounting and dismounting by a user, thereby further enhancing the advantages of the present invention and exciting the appetite of purchasing of the general consumers.

BRIEF DESCRIPTION OF THE DRAWINGS

The present invention will be apparent to those skilled in the art by reading the following description of preferred embodiments of the present invention, with reference to the attached drawings, in which.

DETAILED DESCRIPTION OF THE PREFERRED EMBODIMENTS

Figure 1:
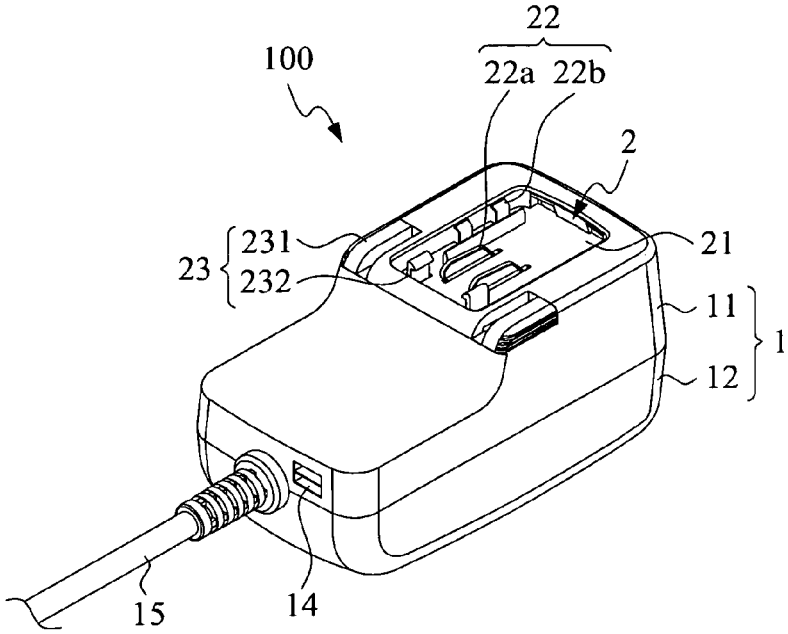
FIG. 1 is a perspective view of an electrical adapter in accordance with the present invention.
Figure 2:
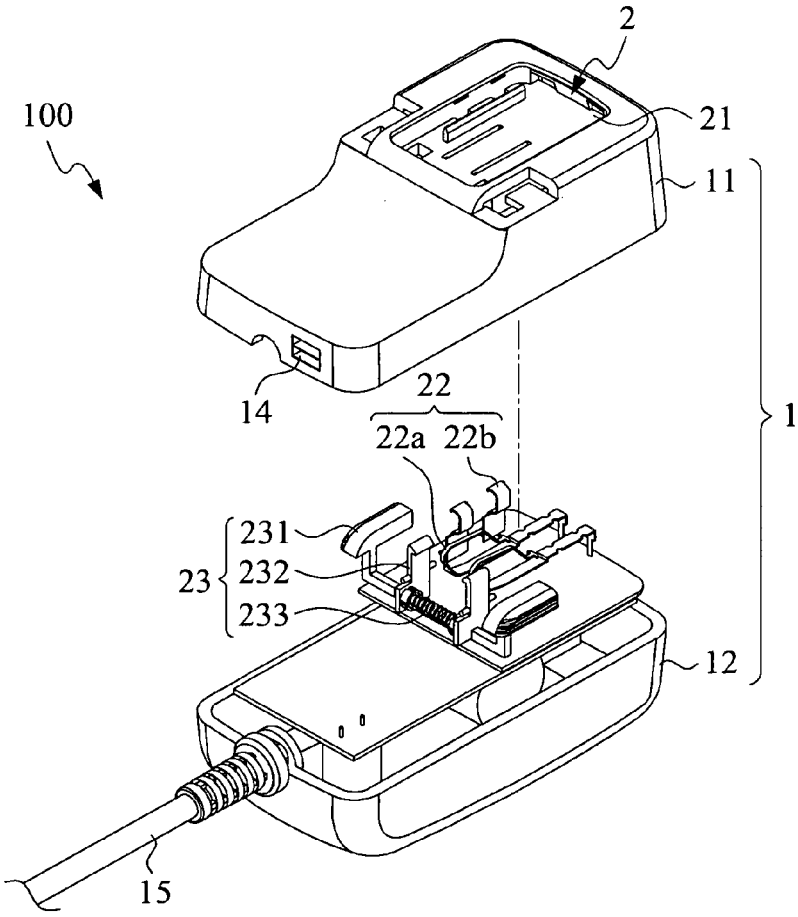
FIG. 2 is an exploded view of the electrical adapter of the present invention.
Figure 3:
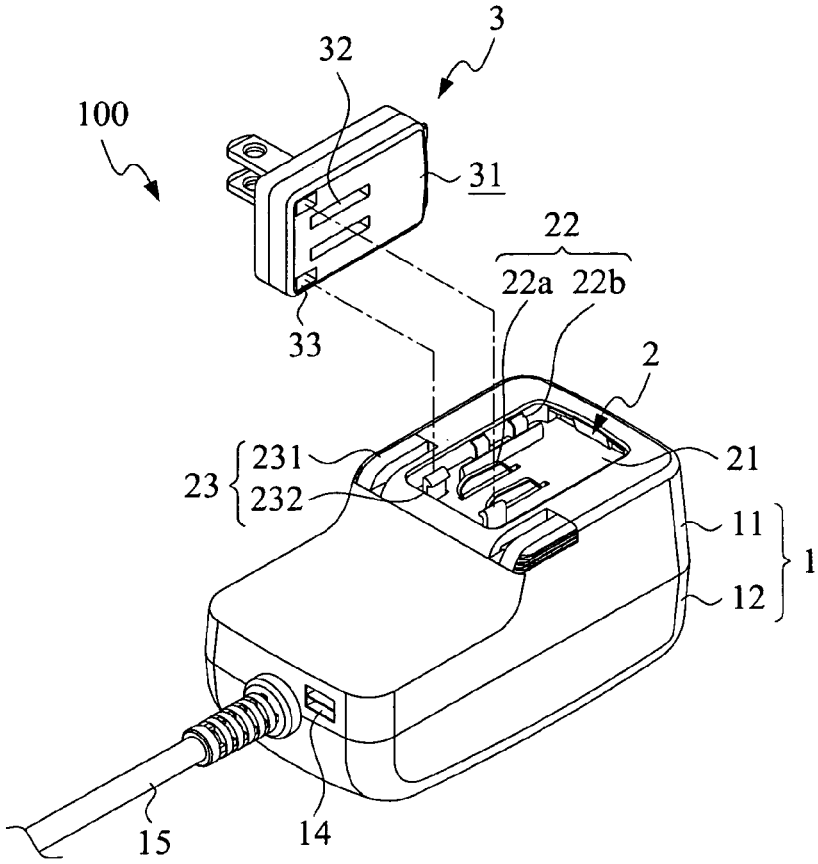
FIG. 3 is an exploded view showing a first embodiment in accordance with the present invention.
Figure 4:
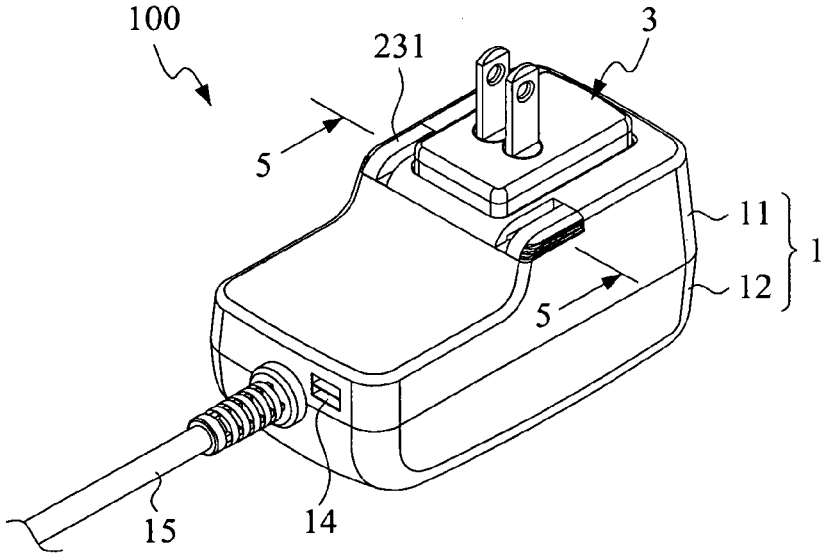
FIG. 4 is a perspective view of the first embodiment of the present invention in an assembled form.
Figure 5:
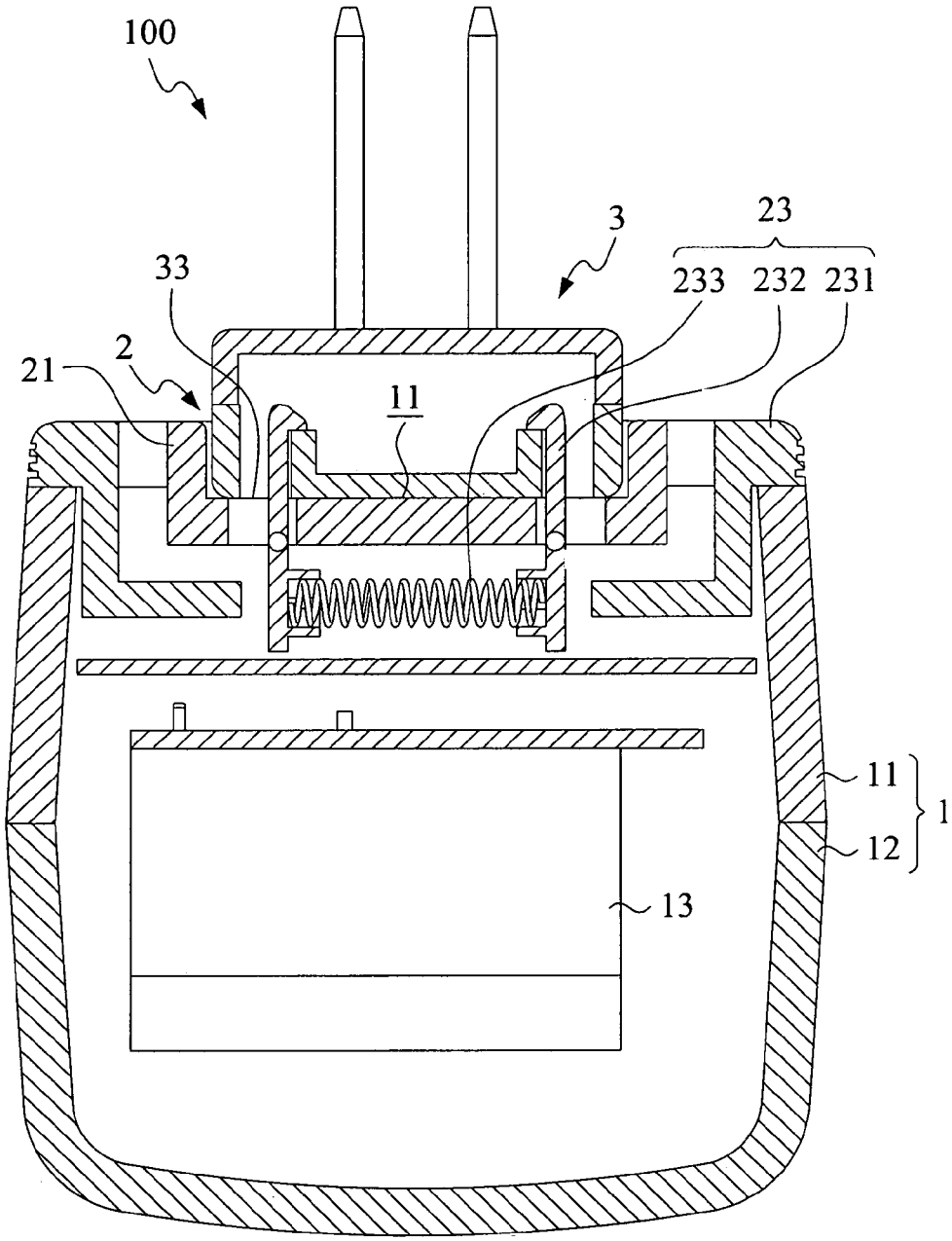
FIG. 5 is a cross-sectional view taken along line 5-5 of FIG. 4.

With reference to the drawings and in particular to FIGS. 1-5, FIG. 1 is a perspective view of an electrical adapter in accordance with the present invention; FIG. 2 is an exploded view of the electrical adapter of the present invention; FIG. 3 is an exploded view showing a first embodiment in accordance with the present invention; FIG. 4 is a perspective view of the first embodiment of the present invention in an assembled form; and FIG. 5 is a cross-sectional view taken along line 5-5 of FIG. 4. As shown in the drawings, the present invention provides an electrical adapter, which is generally designated at 100, comprising an adapter housing 1 and a plug mounting/dismounting structure 2 mounted to the adapter housing 1. In the instant embodiment, the adapter housing 1 is composed of an upper shell 11 and a lower shell 12 mating each other to accommodate therein a circuit assembly 13. The adapter housing 1 also forms a USB (Universal Serial Bus) socket 14. The USB socket 14 is electrically connected to the circuit assembly 13 for receiving a USB device plugged therein. A power output terminal 15 is electrically connected to the circuit assembly 13 for supplying an output of electrical power. A plug structure 3 applicable in the present invention comprises a two-prong plug.

The plug mounting/dismounting structure 2 comprises a carrier 21, at least one set of contact plates 22, and at least one manually-operable fastening structure 23. The carrier 21 is arranged at a predetermined position in the adapter housing 1. The contact plates 22 are in electrical connection with the circuit assembly 13 (see FIG. 5) accommodated in the adapter housing 1 and are exposed on the carrier 21. The manually-operable fastening structure 23 is mounted to the adapter housing 1 and comprises at least one pair of pushbuttons 231 and at least one pawl section 232 (of which the number is two in the instant embodiment). In the instant embodiment, the carrier 21 forms a recessed structure, but the carrier 21 can be made in different forms to suit the needs of various applications.

Figure 6:
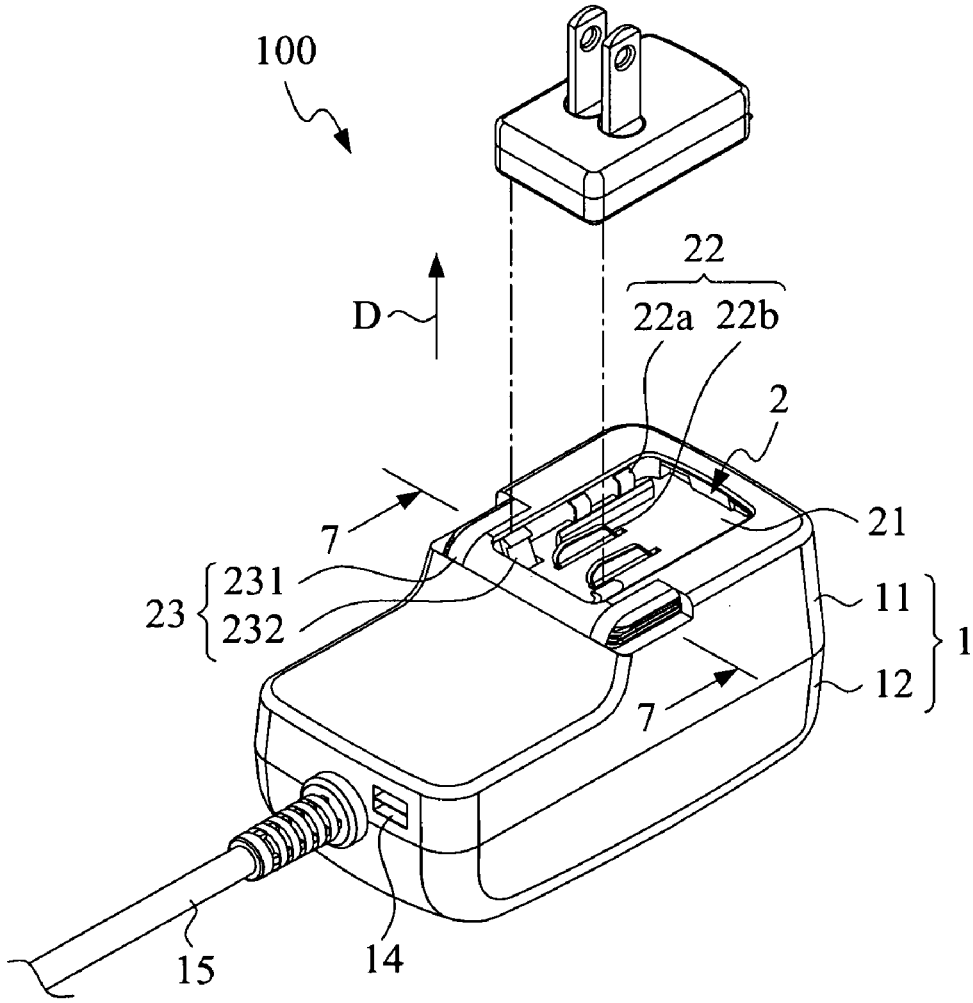
FIG. 6 is an exploded view illustrating an operation of the first embodiment of the present invention.
Figure 7:
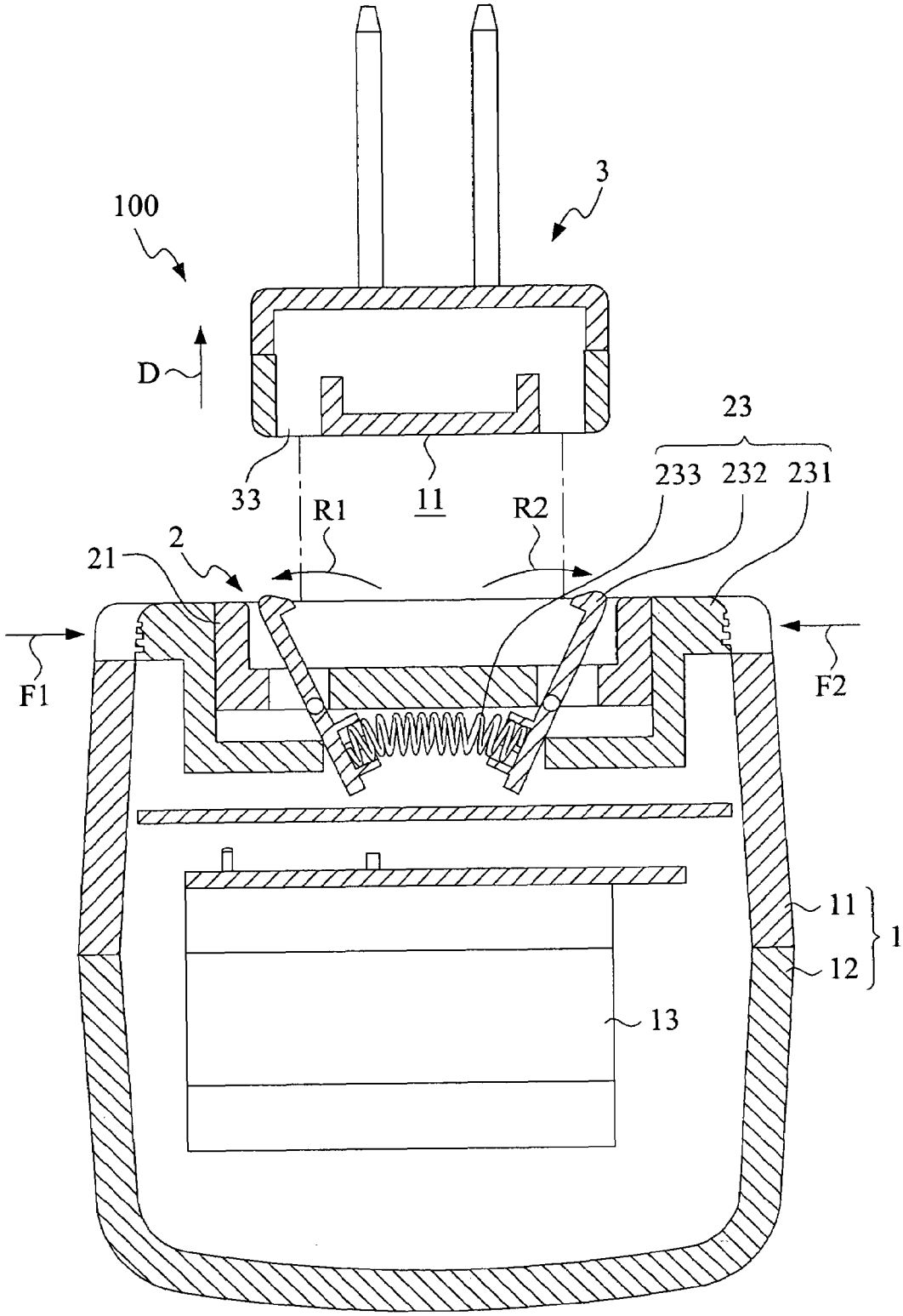
FIG. 7 is a cross-sectional view taken along line 7-7 of FIG. 6.

Referring to FIGS. 6 and 7, of which FIG. 6 is an exploded view illustrating an operation of the first embodiment of the present invention and FIG. 7 is a cross-sectional view taken along line 7-7 of FIG. 6. As shown in the drawings, the pawl sections 232 of the manually-operable fastening structure 23 are set at a locked position (see FIG. 5), when the pushbuttons 231 are not depressed, and are set at a released position (see FIG. 7), when the pushbuttons 231 are depressed in predetermined operation directions F1, F2. In the instant embodiment, the manually-operable fastening structure 23 comprises a returning unit 233, which is coupled to the pawl sections 232 to form an automatic returning arrangement. When the pushbuttons 231 are depressed, the pawl sections 232 are caused to respectively move along paths R1, R2 (see FIG. 7) for releasing, or in opposite directions to re-gain locking.

When the plug structure 3 is set to have a coupling surface 31 thereof coupled to the carrier 21 of the plug mounting/dismounting structure 2, the contact plates 22 are allowed to physically engage corresponding plug-mating contact tabs 32 formed in the coupling surface 31 of the plug structure 3. And, the pawl sections 232 of the manually-operable fastening structure 23 that are located at the locked position correspond in position to and engage locking slots 33 defined in the plug structure 3 When the pawl sections 232 are forced to the released position, the locking slots 33 are allowed to disengage from the pawl sections 232 of the manually-operable fastening structure 23, whereby the plug structure 3 can be moved by a user in a removal direction D to separate from the carrier 21 (see FIG. 6). In accordance with the present invention, the contact plates 22 comprise contact plates 22*a* for transmitting alternating current (AC) power and/or contact plates 22*b* for transmitting direct current (DC) power. Since the present invention adopts a releasable manually-operable fastening structure 23 to couple the adapter housing 1 and the plug structure 3, mounting and/or dismounting by a user is enhanced and made convenient.

Figure 8:
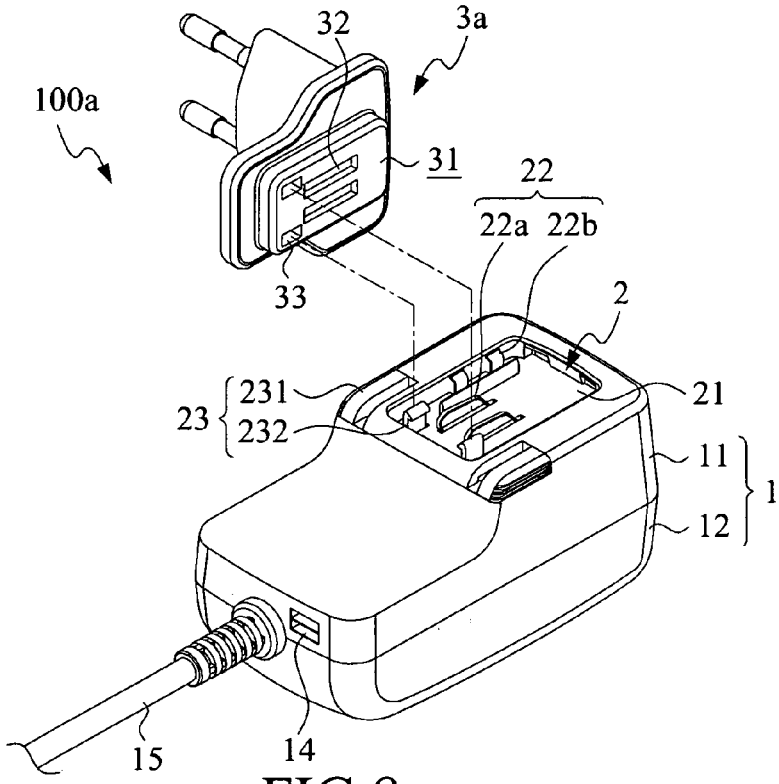
FIG. 8 is an exploded view of a second embodiment in accordance with the present invention.

Referring to FIG. 8, which is an exploded view of a second embodiment in accordance with the present invention, the second embodiment is composed of constituent components substantially identical to those of the first embodiment and the operation thereof is also the same, so that identical components will not be repeatedly described. As shown in the drawing, the electrical adapter 100*a* in accordance with the second embodiment of the present invention comprises a plug structure 3*a*, which is in the form of a two-prong plug. As shown in the drawings, the two-prong plug of the present invention may comprise any plug having two prongs of various shapes and configurations, such as two circular pin like prongs and two flat blade like prongs.

Figure 9:
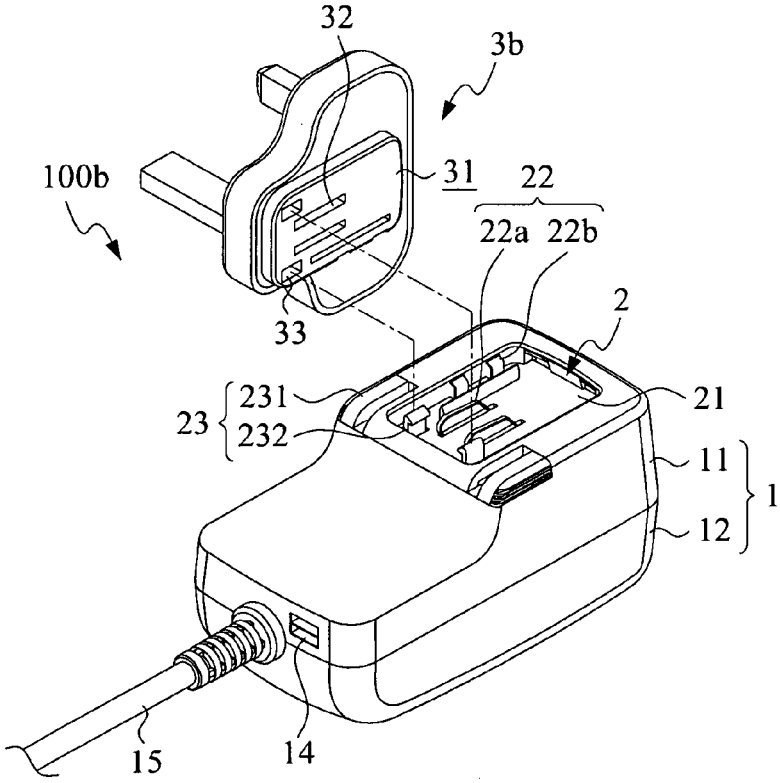
FIG. 9 is an exploded view of a third embodiment in accordance with the present invention.

Referring to FIG. 9, which is an exploded view of a third embodiment in accordance with the present invention, the third embodiment is composed of constituent components substantially identical to those of the first embodiment and the operation thereof is also the same, so that identical components will not be repeatedly described. As shown in the drawing, the electrical adapter 100*b* in accordance with the third embodiment of the present invention comprises a plug structure 3*b*, which is in the form of a three-prong plug. As shown in the drawings, the three-prong plug of the present invention may comprise any plug having two prongs of various shapes and configurations, such as two circular pin like prongs and two flat blade like prongs, and a third grounding prong.

Figure 10:
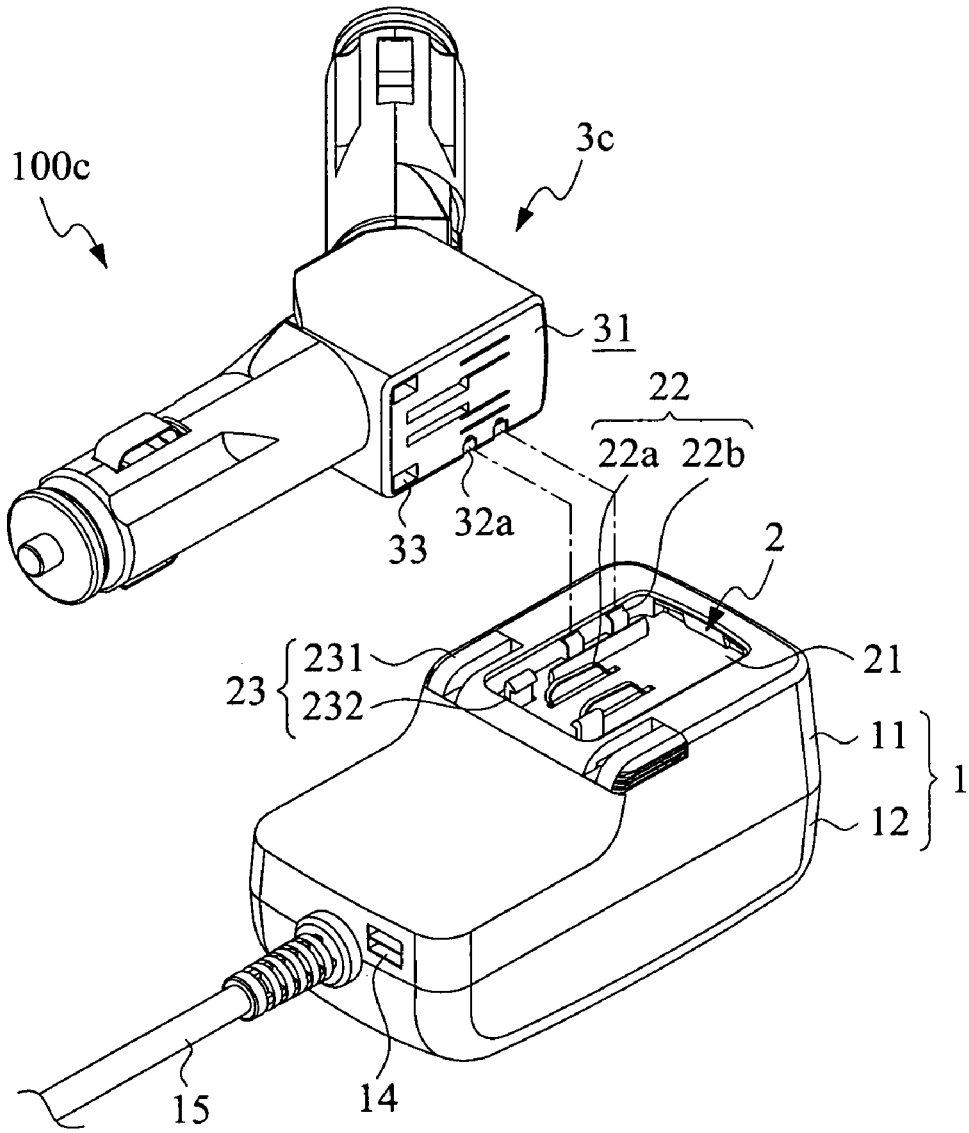
FIG. 10 is an exploded view of a fourth embodiment in accordance with the present invention.

Referring to FIG. 10, which is an exploded view of a fourth embodiment in accordance with the present invention, the fourth embodiment is composed of constituent components substantially identical to those of the first embodiment and the operation thereof is also the same, so that identical components will not be repeatedly described. As shown in the drawing, the electrical adapter 100*c* in accordance with the fourth embodiment of the present invention comprises a plug structure 3*c*, which is made in the form of a cigarette lighter type plug. Since the cigarette lighter type plug of the plug structure 3 requires DC power, the plug structure 3*c* comprises plug-mating contact tabs 32*a* to form engagement with the contact plates 22*b* of DC power. Apparently, the electrical adapter 100 of the present invention can be combined with a plug of various configurations.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. An electrical adapter with a replaceable plug, comprising:

an adapter housing;

a plug mounting/dismounting structure mounted to the adapter housing, which comprises:

a carrier, which is arranged at a predetermined position in the adapter housing;

at least one set of contact plates, which is in electrical connection with a circuit assembly accommodated in the adapter housing and is exposed on the carrier; and at least one releasable fastening structure, which is mounted to the adapter housing and comprises at least one pair of pushbuttons and at least one pawl section, which is set at a locked position when the pushbuttons are not depressed and is set at a released position when the pushbuttons are depressed in a predetermined operation direction;

wherein when a plug structure is set to have a coupling surface thereof coupled to the carrier of the plug mounting/dismounting structure, the contact plates are allowed to physically engage corresponding plug-mating contact tabs formed in the coupling surface of the plug structure and the pawl section of the fastening structure is set at the locked position and corresponds in position to and engages a corresponding locking slot defined in the plug structure; and when the pawl section is forced to the released position, the locking slot is allowed to disengage from the pawl section of the fastening structure, whereby the plug structure is removable from the carrier.

2. The electrical adapter as claimed in claim 1, wherein the plug structure comprises a two-prong plug.

3. The electrical adapter as claimed in claim 1, wherein the plug structure comprises a three-prong plug.

4. The electrical adapter as claimed in claim 3, wherein the three-prong plug comprises a grounding prong.

5. The electrical adapter as claimed in claim 1, wherein the plug structure comprises a cigarette lighter type plug.

6. The electrical adapter as claimed in claim 1, wherein the carrier forms a recessed structure.

7. The electrical adapter as claimed in claim 1, wherein the contact plates comprise contact plates for transmitting alternating current power.

8. The electrical adapter as claimed in claim 1, wherein the contact plates comprise contact plates for transmitting direct current power.

9. The electrical adapter as claimed in claim 1, wherein the adapter housing forms at least one universal serial bus socket, which is electrically connected to the circuit assembly.

* * * * *